US009221580B2

(12) United States Patent
Zelek et al.

(10) Patent No.: US 9,221,580 B2
(45) Date of Patent: Dec. 29, 2015

(54) MULTIPLE PALLET ASSEMBLY

(71) Applicant: Rehrig Pacific Company, Los Angeles, CA (US)

(72) Inventors: John B. Zelek, Los Angeles, CA (US); Jon P. Hassell, Atlanta, GA (US)

(73) Assignee: Rehrig Pacific Company, Los Angeles, CA (US)

( * ) Notice: Subject to any disclaimer, the term of this patent is extended or adjusted under 35 U.S.C. 154(b) by 0 days.

(21) Appl. No.: 14/300,627

(22) Filed: Jun. 10, 2014

(65) Prior Publication Data

US 2015/0068436 A1 Mar. 12, 2015

Related U.S. Application Data

(60) Provisional application No. 61/833,432, filed on Jun. 10, 2013, provisional application No. 61/857,911, filed on Jul. 24, 2013.

(51) Int. Cl.

| | |
|---|---|
| ***B65D 19/00*** | (2006.01) |
| ***B65D 19/38*** | (2006.01) |
| ***B65D 21/02*** | (2006.01) |

(52) U.S. Cl.

CPC ..... *B65D 19/38* (2013.01); *B65D 19/0004* (2013.01); *B65D 19/0018* (2013.01); *B65D 19/0097* (2013.01); *B65D 21/0233* (2013.01); *B65D 2519/00034* (2013.01); *B65D 2519/00069* (2013.01); *B65D 2519/00268* (2013.01); *B65D 2519/00273* (2013.01); *B65D 2519/00288* (2013.01); *B65D 2519/00293* (2013.01); *B65D 2519/00308* (2013.01); *B65D 2519/00318* (2013.01); *B65D 2519/00338* (2013.01); *B65D 2519/00756* (2013.01); *B65D 2519/00771* (2013.01)

(58) Field of Classification Search

CPC ..... B65D 2519/00268; B65D 19/38; B65D 2519/00069; B65D 2519/00034; B65D 2519/0094

USPC ..... 248/346.02; 108/53.1, 53.3, 53.5, 108/57.25, 57.31, 57.33, 57.28, 51.11, 901, 108/57.26; 206/386, 598, 600

See application file for complete search history.

(56) References Cited

U.S. PATENT DOCUMENTS

| | | | | |
|---|---|---|---|---|
| 2,420,625 | A * | 5/1947 | Stalnaker et al. | 206/595 |
| 2,639,050 | A * | 5/1953 | Hoffmann, Jr. | 414/416.12 |
| 2,739,776 | A | 3/1956 | Terando | |
| 3,042,221 | A * | 7/1962 | Rasmussen | 211/183 |
| 3,307,504 | A | 3/1967 | Cloyd | |

(Continued)

FOREIGN PATENT DOCUMENTS

| | | | |
|---|---|---|---|
| EP | 2465784 | * | 6/2012 |
| FR | 2391115 | A1 | 12/1978 |

(Continued)

*Primary Examiner* — Janet M Wilkens

(74) *Attorney, Agent, or Firm* — Carlson, Gaskey & Olds P.C.

(57) ABSTRACT

A pallet assembly includes a support base including a support deck having a plurality of openings. A plurality of pallets each include a pallet deck having a plurality of feet extending downward therefrom. The plurality of pallets are arranged such that the plurality of feet are received in the plurality of openings in the support deck of the support base. In this manner, a plurality of smaller pallets can be handled as a single standard size pallet, including being stacked in a pallet rack.

19 Claims, 19 Drawing Sheets

(56) References Cited

U.S. PATENT DOCUMENTS

| | | | | | |
|---|---|---|---|---|---|
| 3,342,146 | A | | 9/1967 | Lessheim | |
| 3,528,192 | A | | 9/1970 | Meates | |
| 3,650,224 | A | | 3/1972 | Petix et al. | |
| 3,857,342 | A | | 12/1974 | Johns | |
| 3,916,803 | A | * | 11/1975 | Garcia | 108/57.28 |
| 4,013,021 | A | | 3/1977 | Steinlein et al. | |
| 4,344,368 | A | * | 8/1982 | Remington et al. | 108/57.15 |
| 4,597,338 | A | | 7/1986 | Kreeger | |
| 4,694,962 | A | | 9/1987 | Taub | |
| 4,742,781 | A | * | 5/1988 | Shuert | 108/53.3 |
| 4,895,080 | A | * | 1/1990 | Thomas | 108/56.1 |
| 5,094,175 | A | | 3/1992 | Christie | |
| 5,105,746 | A | | 4/1992 | Reynolds | |
| 5,388,533 | A | | 2/1995 | Pigott et al. | |
| 5,483,899 | A | | 1/1996 | Christie | |
| 5,492,069 | A | | 2/1996 | Alexander et al. | |
| 5,666,886 | A | * | 9/1997 | Alexander et al. | 108/56.3 |
| 5,720,399 | A | * | 2/1998 | Kohlhaas | 211/133.1 |
| 5,794,543 | A | | 8/1998 | John et al. | |
| 5,809,904 | A | | 9/1998 | Darby | |
| 5,830,299 | A | * | 11/1998 | Teixidor Casanovas et al. | 156/70 |
| 5,860,369 | A | | 1/1999 | John et al. | |
| 5,868,080 | A | * | 2/1999 | Wyler et al. | 108/57.25 |
| 5,887,529 | A | | 3/1999 | John et al. | |
| 5,934,486 | A | | 8/1999 | Jarvis et al. | |
| 6,053,466 | A | * | 4/2000 | Jordan et al. | 248/346.01 |
| 6,173,659 | B1 | | 1/2001 | Danks et al. | |
| 6,234,087 | B1 | | 5/2001 | Brown | |
| 6,273,006 | B1 | | 8/2001 | Reutter et al. | |
| 6,286,693 | B1 | * | 9/2001 | Brown | 211/181.1 |
| 6,357,366 | B1 | | 3/2002 | Frankenberg | |
| 6,360,676 | B1 | * | 3/2002 | Schepers | 108/52.1 |
| 6,863,003 | B2 | * | 3/2005 | Grainger | 108/51.11 |
| 6,938,559 | B2 | | 9/2005 | Wullenweber | |
| 7,275,489 | B1 | * | 10/2007 | Shuert | 108/57.25 |
| 7,360,493 | B2 | | 4/2008 | Hummel et al. | |
| 7,640,867 | B2 | | 1/2010 | Ogburn et al. | |
| 7,735,429 | B2 | | 6/2010 | Meissen | |
| 7,779,764 | B2 | | 8/2010 | Naidu et al. | |
| 8,267,018 | B2 | * | 9/2012 | Gunn | 108/53.1 |
| D674,631 | S | * | 1/2013 | Blanc | D6/707.22 |
| 8,707,874 | B2 | * | 4/2014 | Ritzberger et al. | 108/51.11 |
| 2004/0218276 | A1 | * | 11/2004 | Apps et al. | 359/582 |
| 2007/0256609 | A1 | | 11/2007 | Naidu et al. | |
| 2008/0083355 | A1 | * | 4/2008 | Meissen | 108/57.25 |
| 2008/0112771 | A1 | * | 5/2008 | Barney et al. | 410/46 |
| 2008/0308015 | A1 | * | 12/2008 | Apps | 108/53.3 |
| 2009/0236809 | A1 | * | 9/2009 | Carver et al. | 280/43.12 |
| 2011/0253016 | A1 | * | 10/2011 | Leakey | 108/56.3 |
| 2012/0111238 | A1 | * | 5/2012 | Frankenberg | 108/57.25 |
| 2014/0033956 | A1 | * | 2/2014 | Kelly et al. | 108/50.11 |
| 2014/0345500 | A1 | * | 11/2014 | Dunn | 108/53.3 |

FOREIGN PATENT DOCUMENTS

| | | | | |
|---|---|---|---|---|
| GB | 1156430 | A | | 6/1969 |
| GB | 2326028 | | * | 9/1998 |
| WO | 9957025 | A1 | | 11/1999 |
| WO | 2013022400 | A1 | | 2/2013 |

* cited by examiner

MULTIPLE PALLET ASSEMBLY

BACKGROUND

Standard size pallets, including plastic pallets, are used to support goods above a floor so that they can be lifted and moved by fork tines, such as on a fork lift. For storage or shipping, the pallets may be loaded into a rack where the loaded pallets are supported only at outer edges on rails in the pallet rack.

Sometimes it is more convenient to use half-size pallets, especially when the pallets are intended to be delivered into a store or into a refrigerator or freezer where a standard-size pallet would be unwieldy. However, in a warehouse or distribution facility where there is plenty of room for standard size pallets, the half pallets still require twice as much handling, because the fork lift will have to handle each half-pallet separately. Further, the half-pallets cannot be stored on a pallet rack.

SUMMARY

A pallet assembly includes a support base including a support deck having a plurality of openings therethrough. A plurality of pallets each include a pallet deck having a plurality of feet extending downward therefrom. The plurality of pallets are arranged such that the plurality of feet are received in the plurality of openings in the support deck of the support base.

In this manner, a plurality of smaller pallets can be handled at the same time as if they were a single standard size pallet. Further, the plurality of pallets in the assembly with the support base can be stacked in a pallet rack.

DETAILED DESCRIPTION OF A PREFERRED EMBODIMENT

Figure 1:
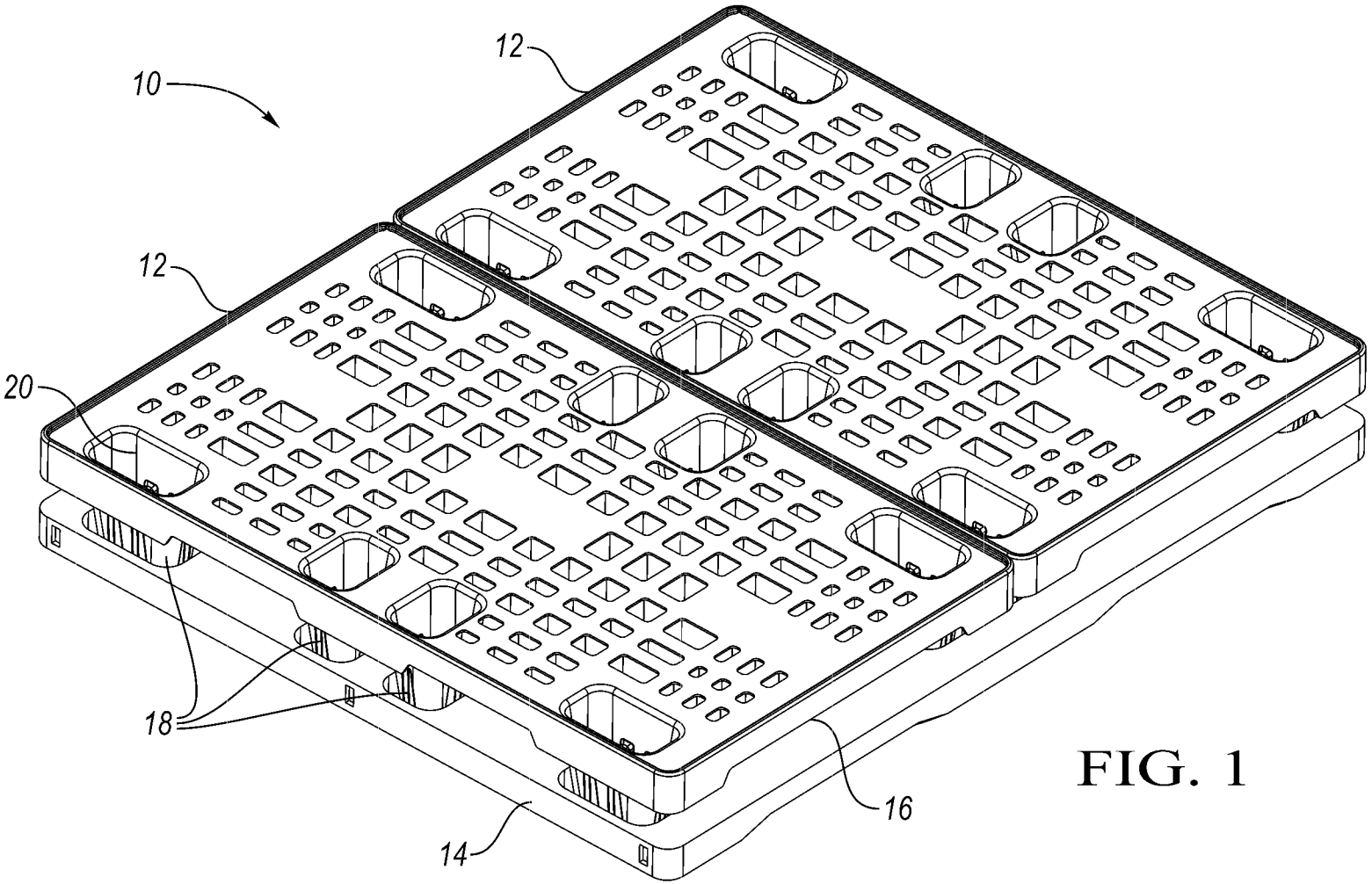
FIG. 1 is a perspective view of a multiple pallet assembly according to a first embodiment.

A pallet assembly 10 according to a first embodiment is shown in FIG. 1. The pallet assembly 10 includes a plurality of pallets 12 (in this example, two) and a support base 14. Each of the pallets 12 may be injection molded as a single piece of plastic or as more than one piece subsequently joined together as known. The support base 14 may also be injection molded as a single piece of plastic or as more than one piece subsequently joined together with known techniques.

The pallets 12 are nestable pallets 12 each having a deck 16 supported above the floor by a plurality of columns or feet 18. Openings 20 through the deck 16 are aligned with the feet 18 so that the feet of an identical pallet 12 can be nested therein. In this example, each pallet 12 includes four corner feet 18 and a pair of side feet 18 (which could be considered a single, split foot 18) along each long edge of the pallet 12.

In FIG. 1, the pallets 12 are positioned on the support base 14, which is on a floor. The feet 18 of the pallets 12 contact the floor.

Figure 2:
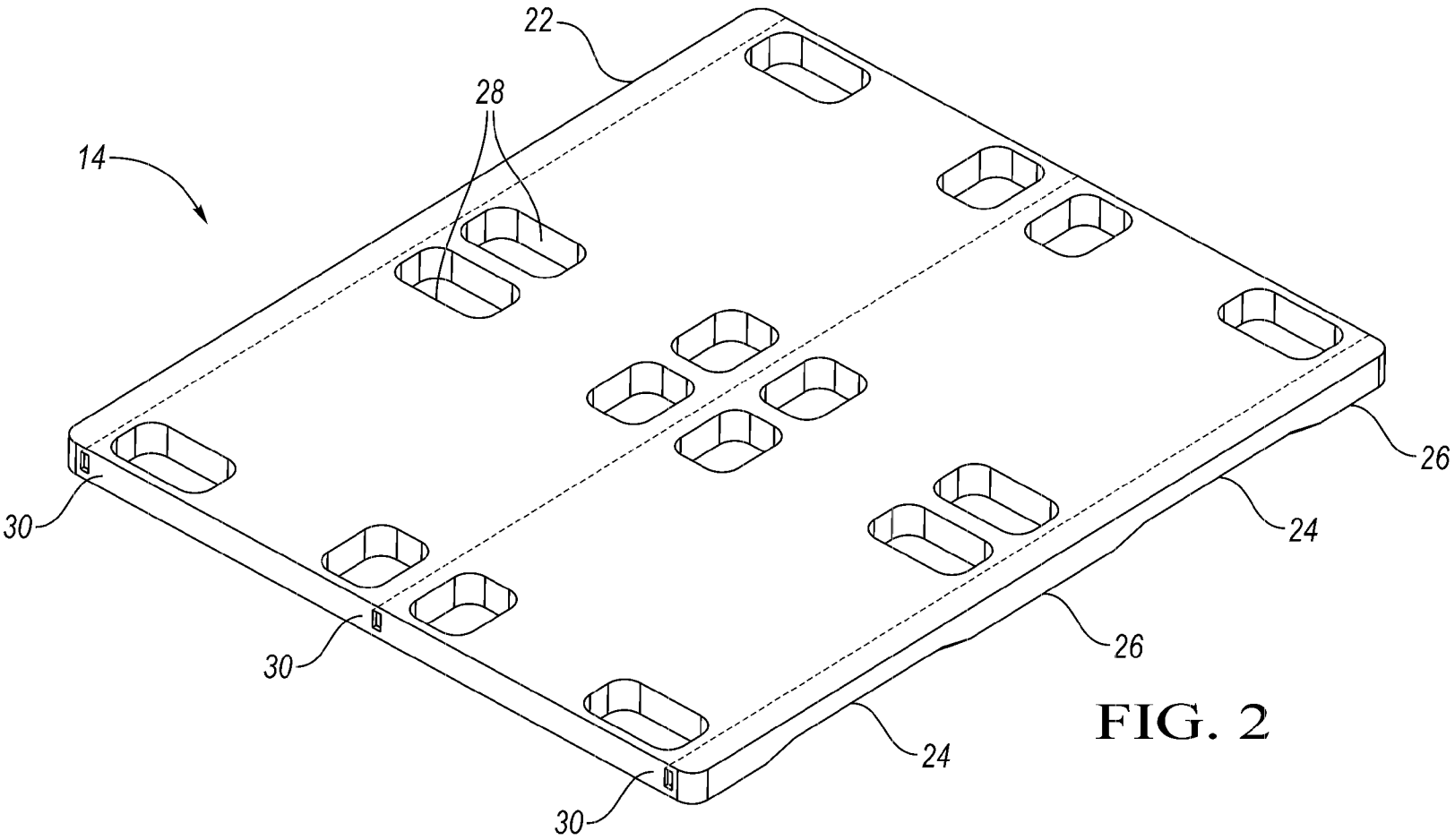
FIG. 2 is a perspective view of the support base of FIG. 1.

FIG. 2 is a perspective view of the support base 14. The support base 14 includes a deck 22 having a pair of fork tine-receiving recesses 24 on its underside. The deck 22 is supportable on the floor on base portions 26. The tine-receiving recesses 24 are between the base portions 26. A plurality of openings 28 are formed through the deck 22 in the pattern of the feet 18 of the pallets 12 (FIG. 1). A plurality of reinforcement members 30 (such as steel rods, tubes, composite materials or stiffer materials, etc) are secured to the deck 22 of the support base 14 and extend across the long dimension of the deck 22. The deck 22 may include an upper panel portion with a plurality of ribs extending downwardly therefrom. The reinforcement members 30 may be secured between the ribs on the underside of the deck 22.

Figure 3:
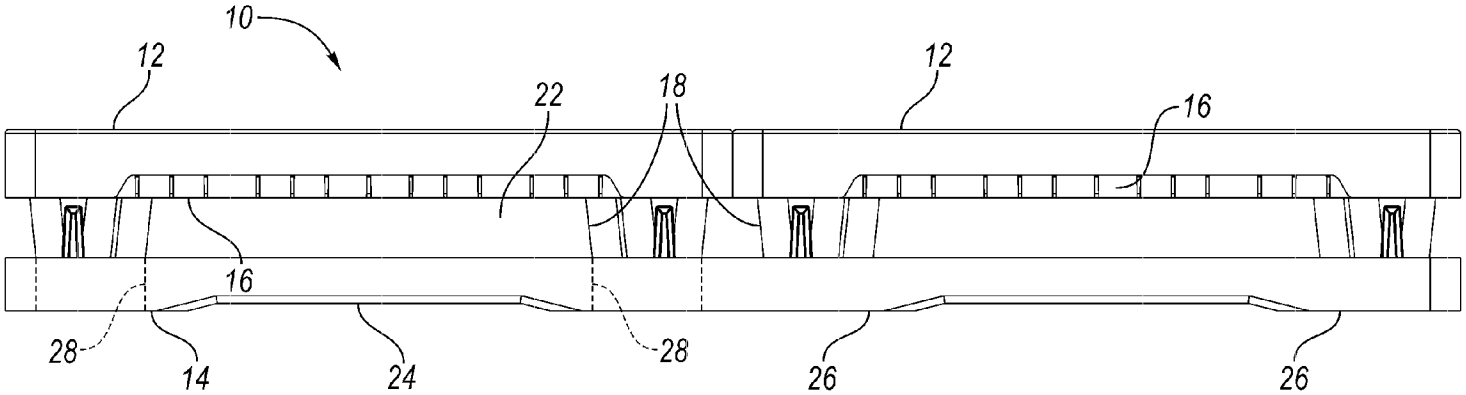
FIG. 3 is a front view of the pallet assembly of FIG. 1.
Figure 4:
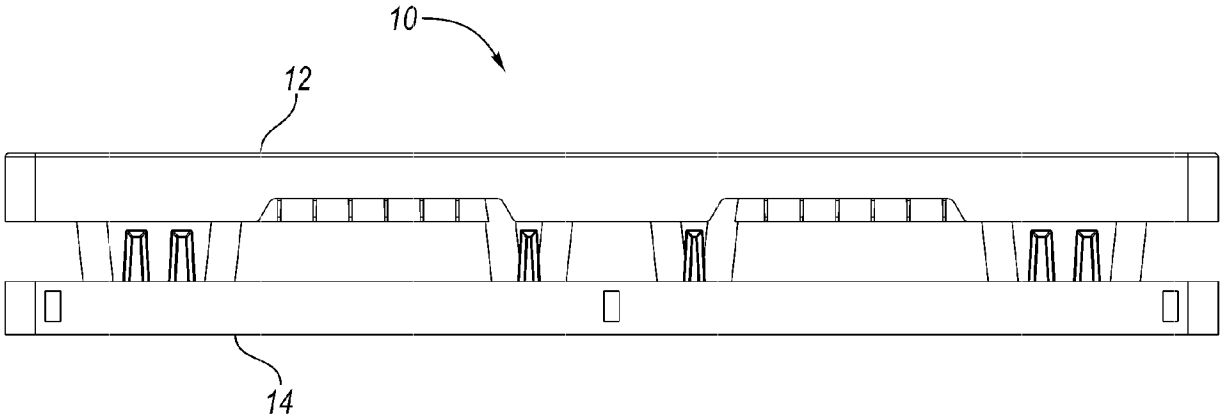
FIG. 4 is a side view of the pallet assembly of FIG. 1.

FIG. 3 is a front view of the pallet assembly 10 of FIG. 1. The columns 18 of the pallets 12 are received in the openings 28 in the support base 14. The columns 18 contact the floor through the openings 28 and are supported on the floor. In this position, the fork of a forklift can be inserted through the openings defined between the columns 18 and between the deck 16 and the deck 22 to lift the pallet 12 away from the support base 14. Alternatively, the fork can be inserted through the fork tine receiving recesses 24 of the support base 14, so that the forklift can lift both pallets 12 and the support base 14. FIG. 4 is a side view of the pallet assembly 10 of FIG. 3.

Figure 5:
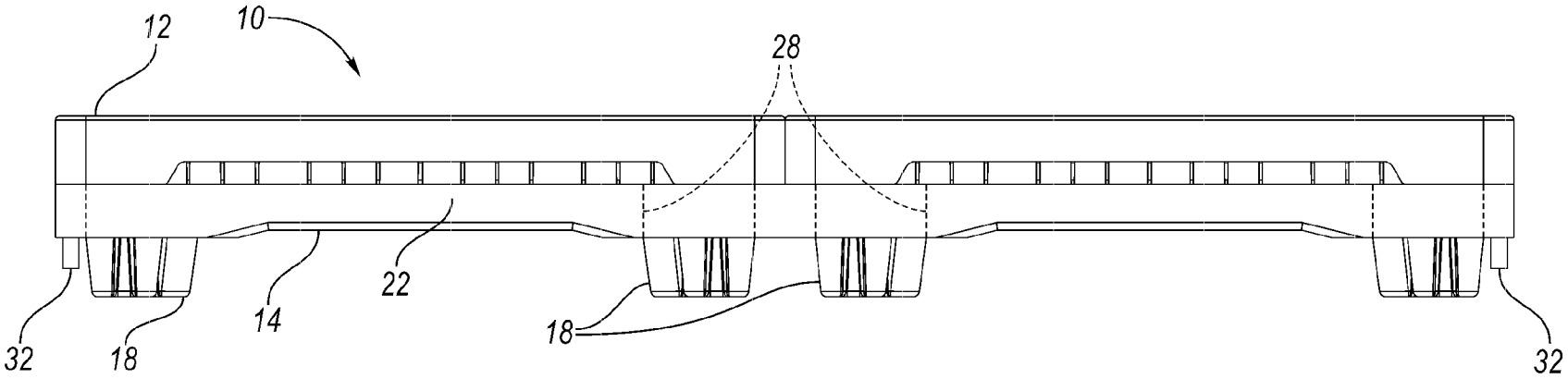
FIG. 5 is a front view of the pallet assembly of FIG. 1 with the support base raised to a lifting or racked position.
Figure 6:
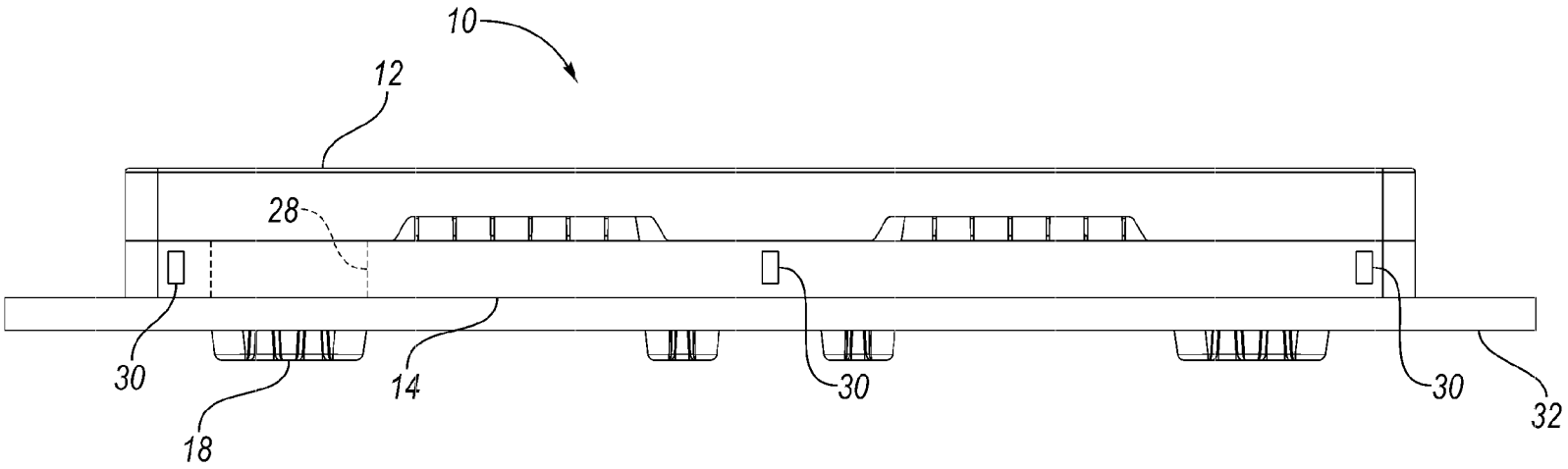
FIG. 6 is a side view of the pallet assembly of FIG. 5.

When the pallet assembly 10 is lifted by the fork tines below the deck 22 of the support base 14, the support base 14 rises up the columns 18 of the pallet 12 until the deck 22 of the support base 14 contacts the decks 16 of the pallets 12, as shown in FIGS. 5 and 6. Then, the fork lift can lift both pallets 12 with the support base 14.

As shown in FIG. 6, the side columns 18 of the pallets 12 are received on either side of the center one of the reinforcement members 30. This is why the side columns 18 are split into two side columns 18.

Figure 7:
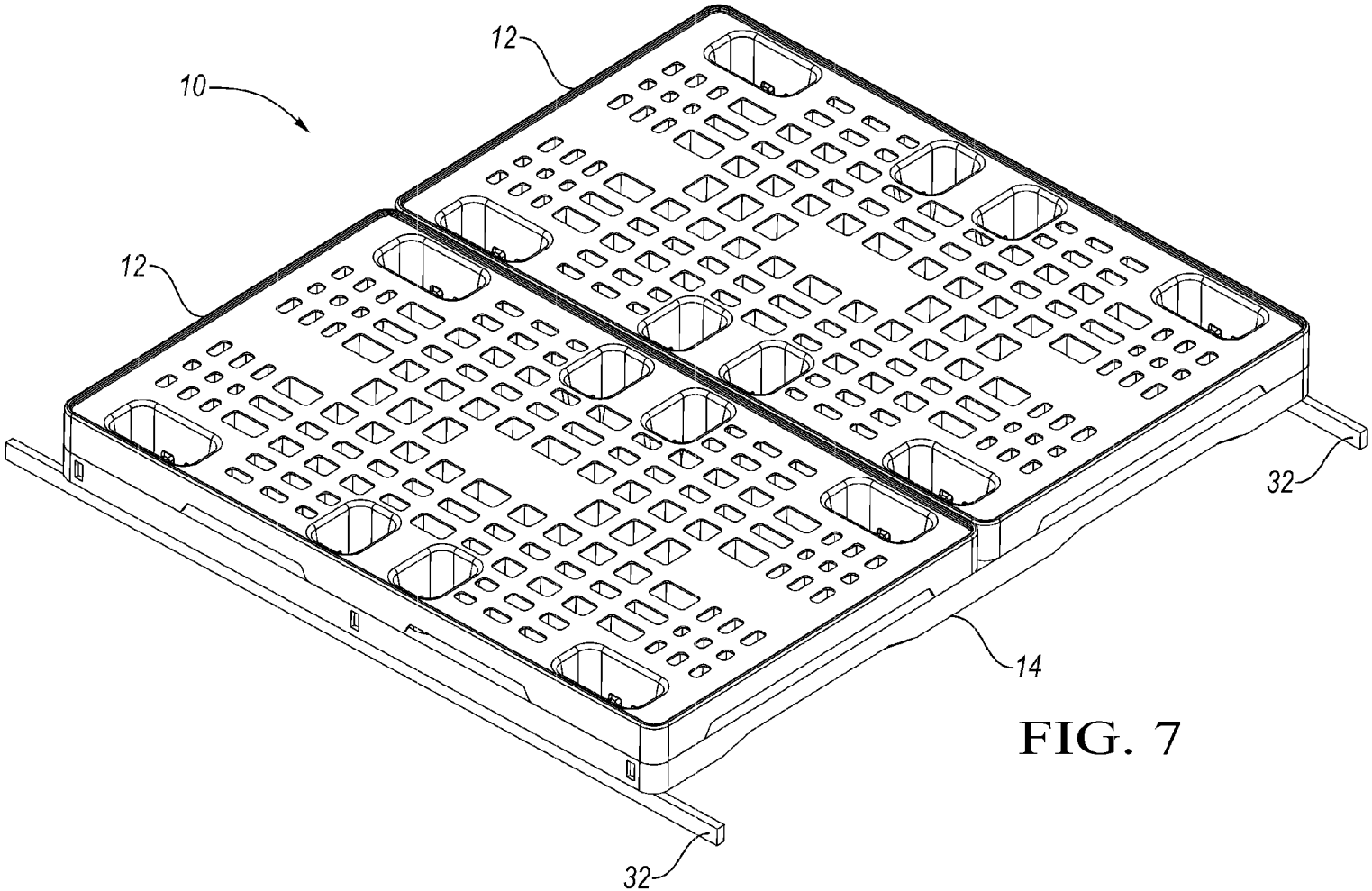
FIG. 7 is a perspective view of the pallet assembly and rack rails of FIG. 5.

As is also shown in FIGS. 5 and 6, when supported on the support base 14, the pallets 12 can be supported on a rack having end rails 32. The end rails 32 support the support base 14 outward of the corner columns 18 and are perpendicular (or at least substantially perpendicular) to the reinforcement members 30. A perspective view of the pallet assembly 10 supported on the rack (and end rails 32) is shown in FIG. 7.

Figure 8:
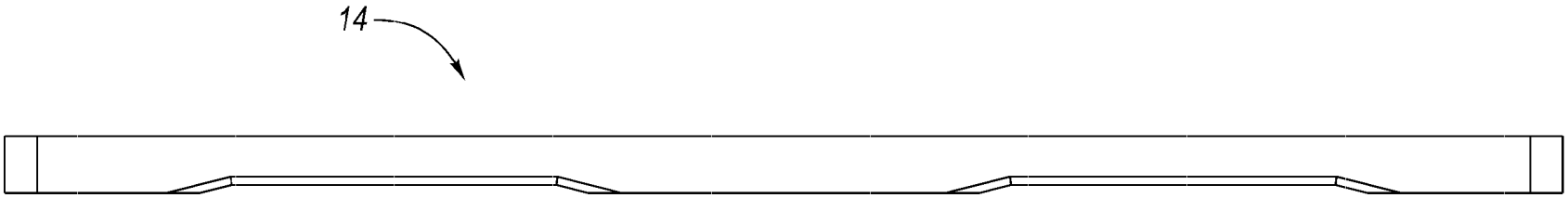
FIG. 8 is a front view of the support base of FIG. 1.
Figure 9:
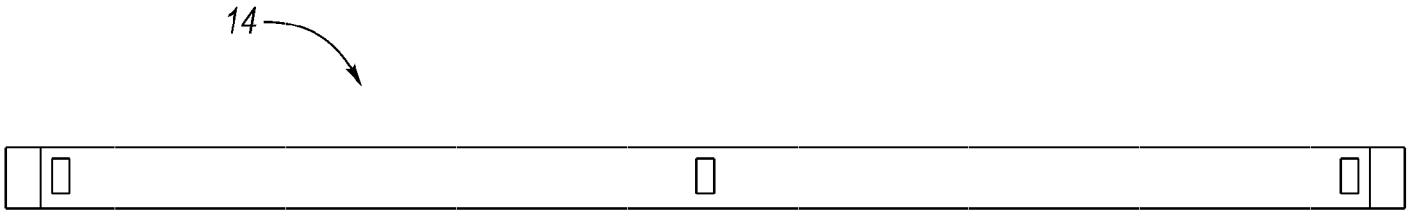
FIG. 9 is a side view of the support base of FIG. 1.

FIG. 8 is a front view of the support base 14. FIG. 9 is a side view of the support base 14.

Figure 10:
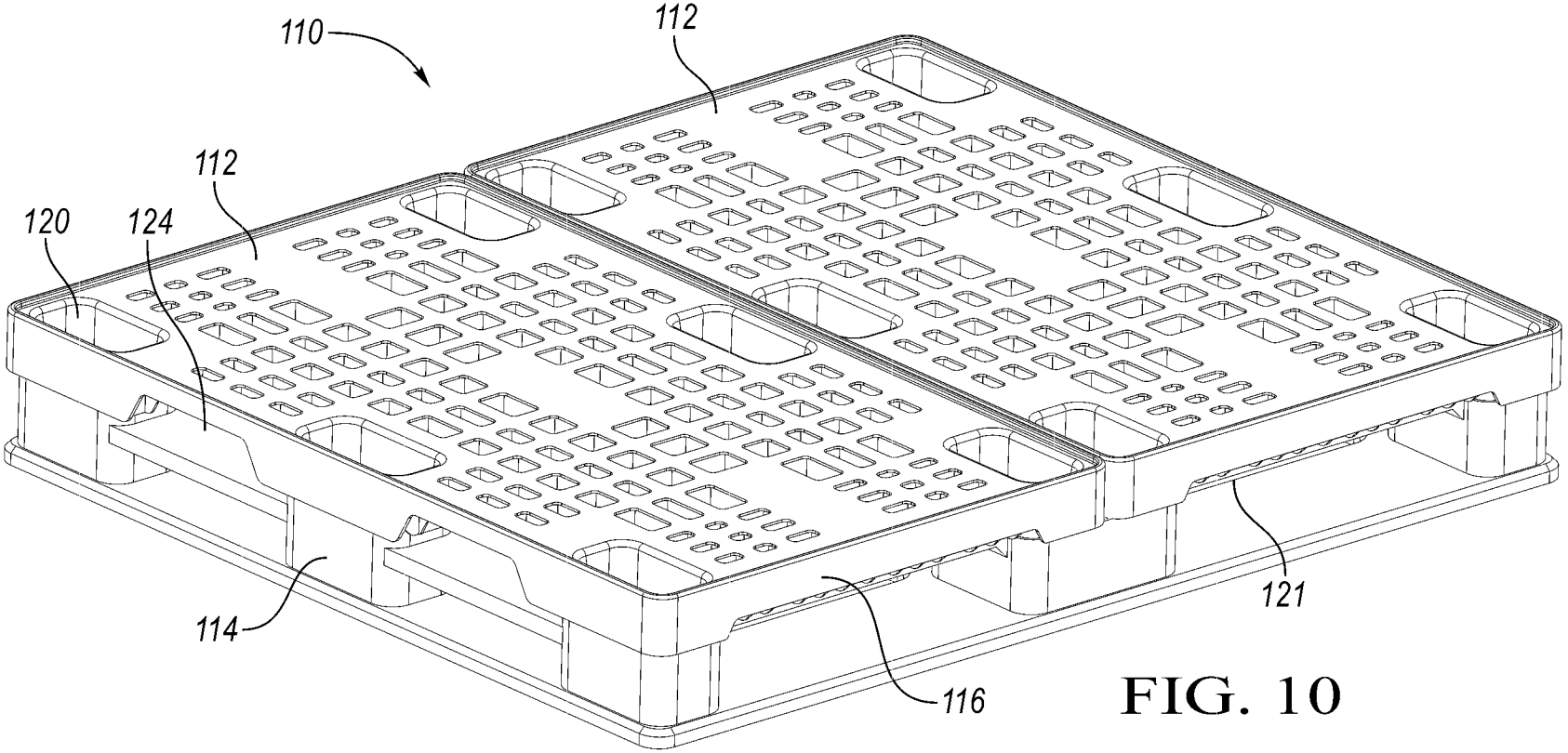
FIG. 10 is a perspective view of a multiple pallet assembly according to a second embodiment.

Another pallet assembly 110 according to a second embodiment is shown in FIG. 10. The pallet assembly 110 includes a plurality of pallets 112 (in this example, two) and a support base 114. Each of the pallets 112 may be injection molded as a single piece of plastic or as more than one piece subsequently joined together as known. The support base 114 may also be injection molded as a single piece of plastic or as more than one piece subsequently joined together as known.

Figure 11:
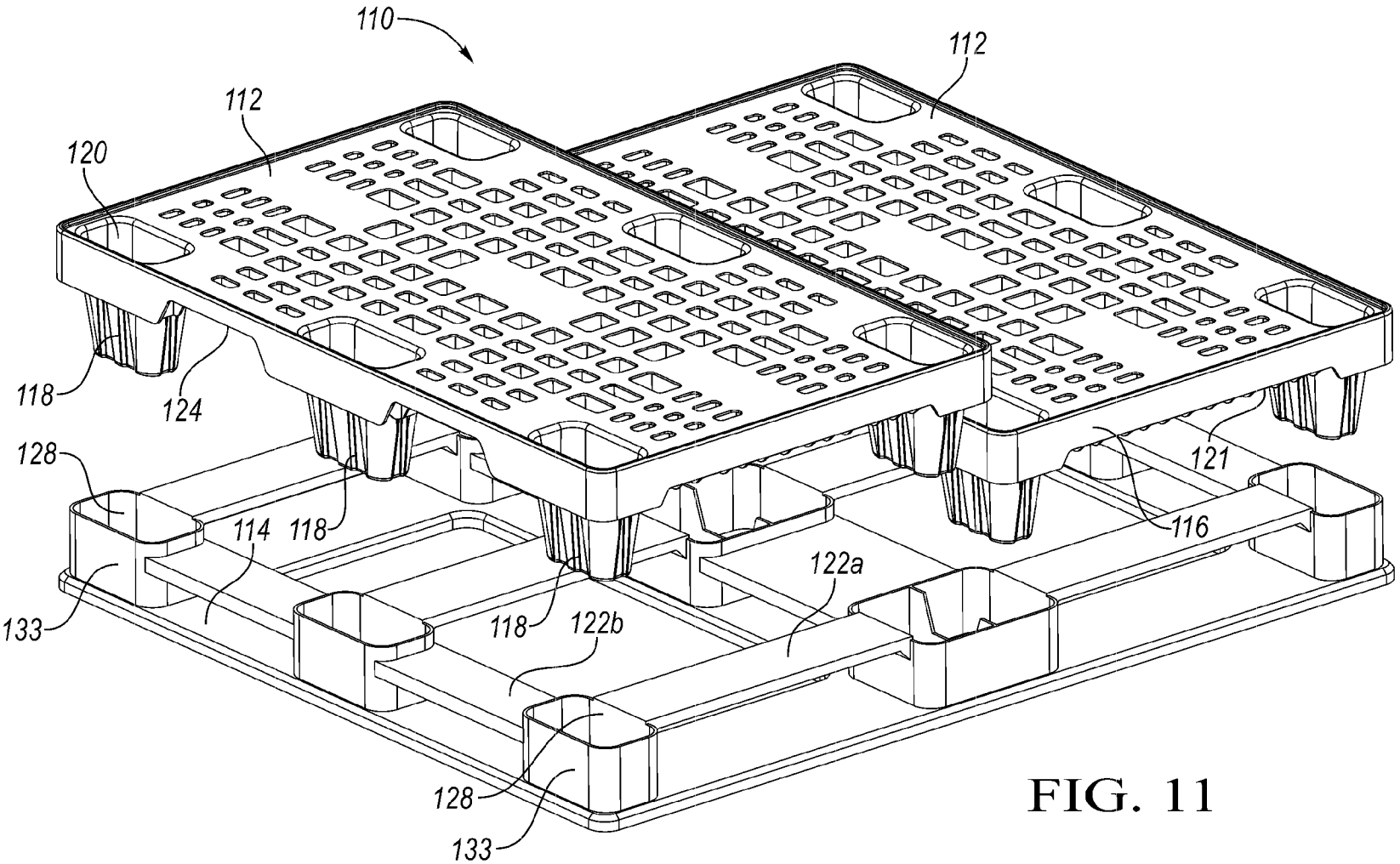
FIG. 11 is an exploded view of the pallet assembly of FIG. 10.

The pallets 112 are nestable pallets 112 each having a deck 116 supported above the floor by a plurality of columns or feet 118 (shown in FIG. 11). Openings 120 through the deck 116 are aligned with the feet 118 so that the feet of an identical pallet 112 can be nested therein. In this example, each pallet 112 includes four corner feet 118 and a pair of side feet 118 (which could be considered a single, split foot 118) along each long edge of the pallet 112. Opposing sides of the pallets 112 include recesses 124 on the underside, and the other opposing sides of the pallets 112 include recesses 121 on the underside. The recesses 124 have a greater height than the recesses 121.

Figure 12:
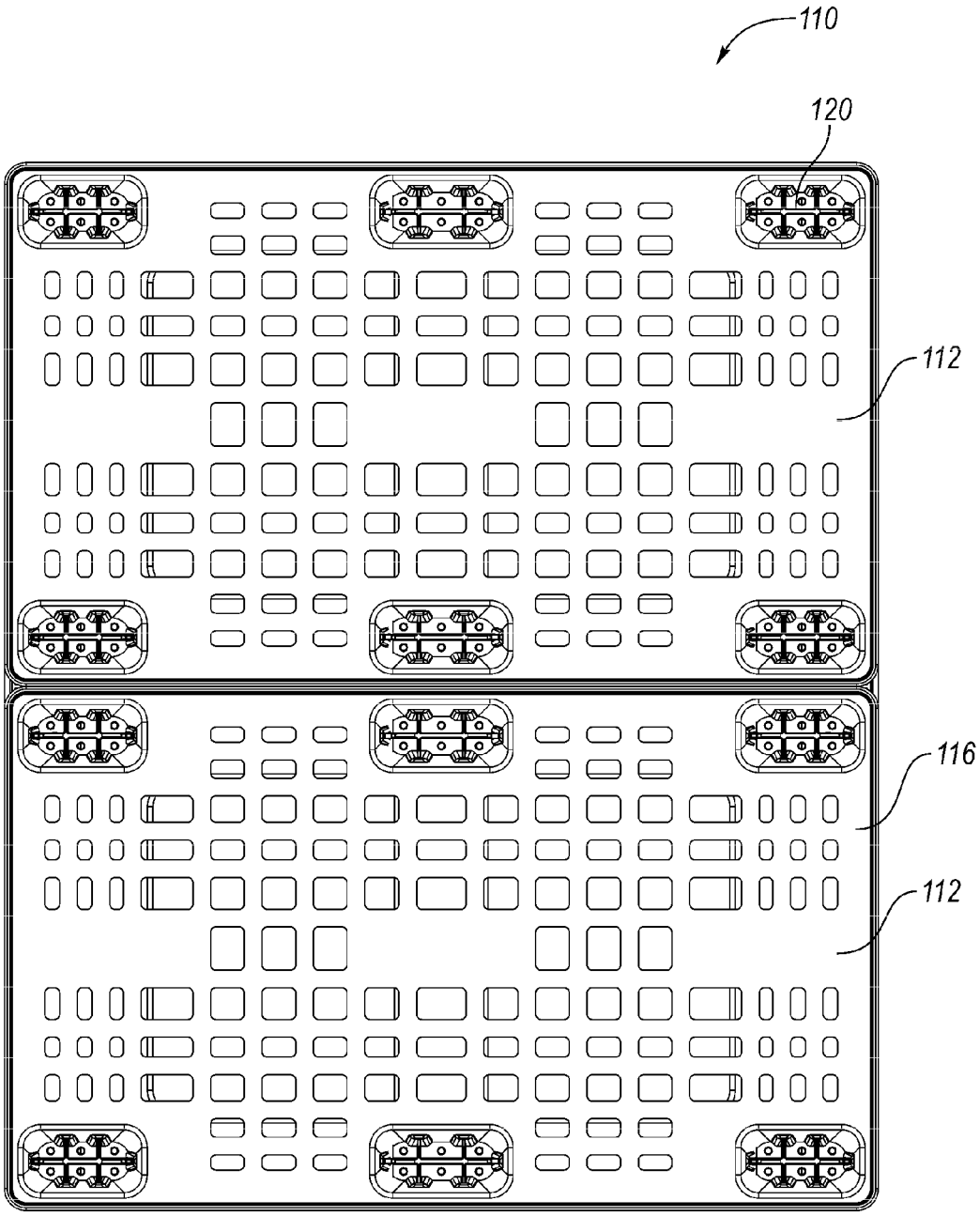
FIG. 12 is a top view of the pallet assembly of FIG. 10.
Figure 13:
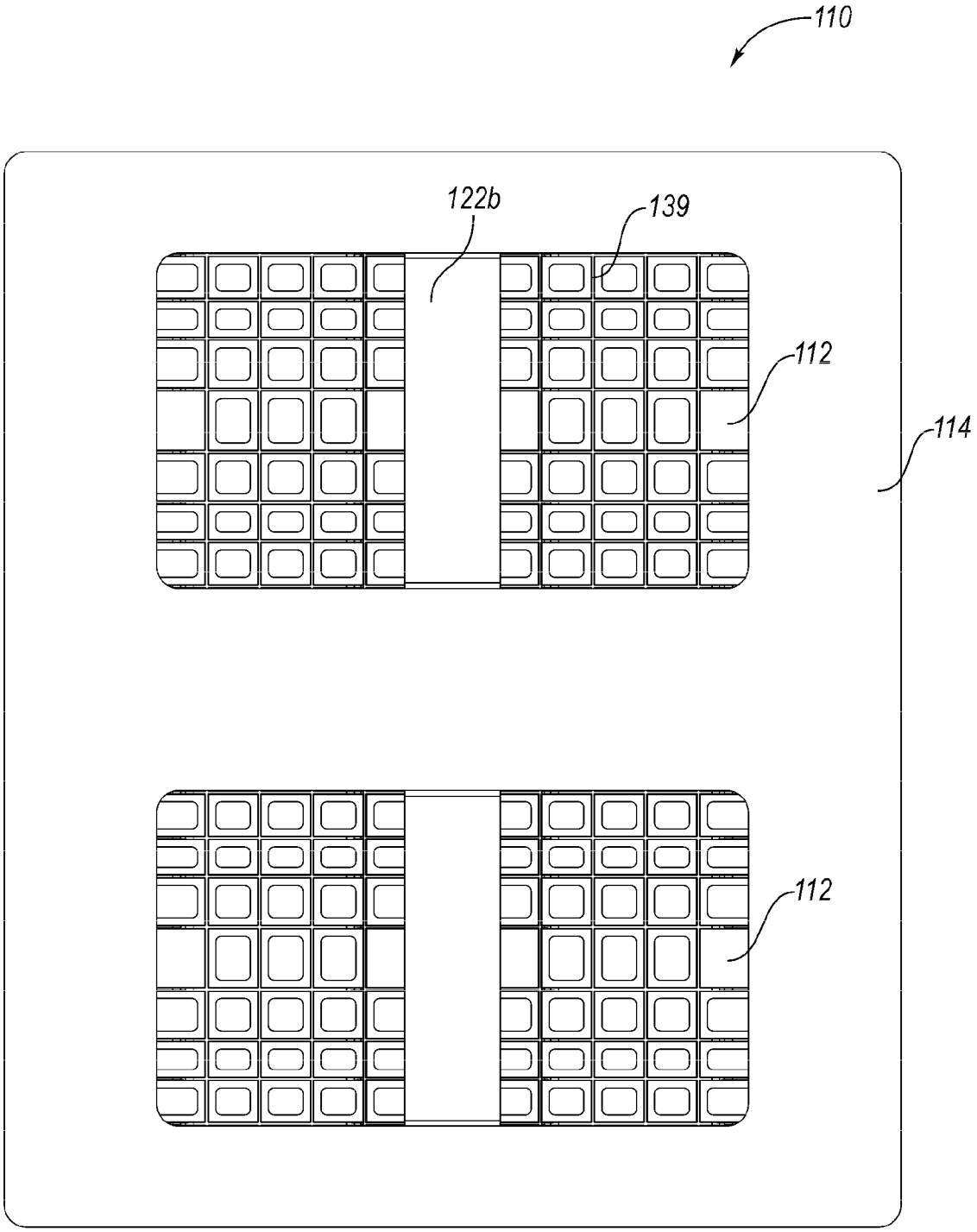
FIG. 13 is a bottom view of the pallet assembly of FIG. 10

In FIGS. 10, 11, 12 and 13, the pallets 112 are positioned on the support base 114, which is on a floor. FIG. 12 shows a top view of the pallet assembly 110, and FIG. 13 shows a bottom view of the pallet assembly 110.

Figure 14:
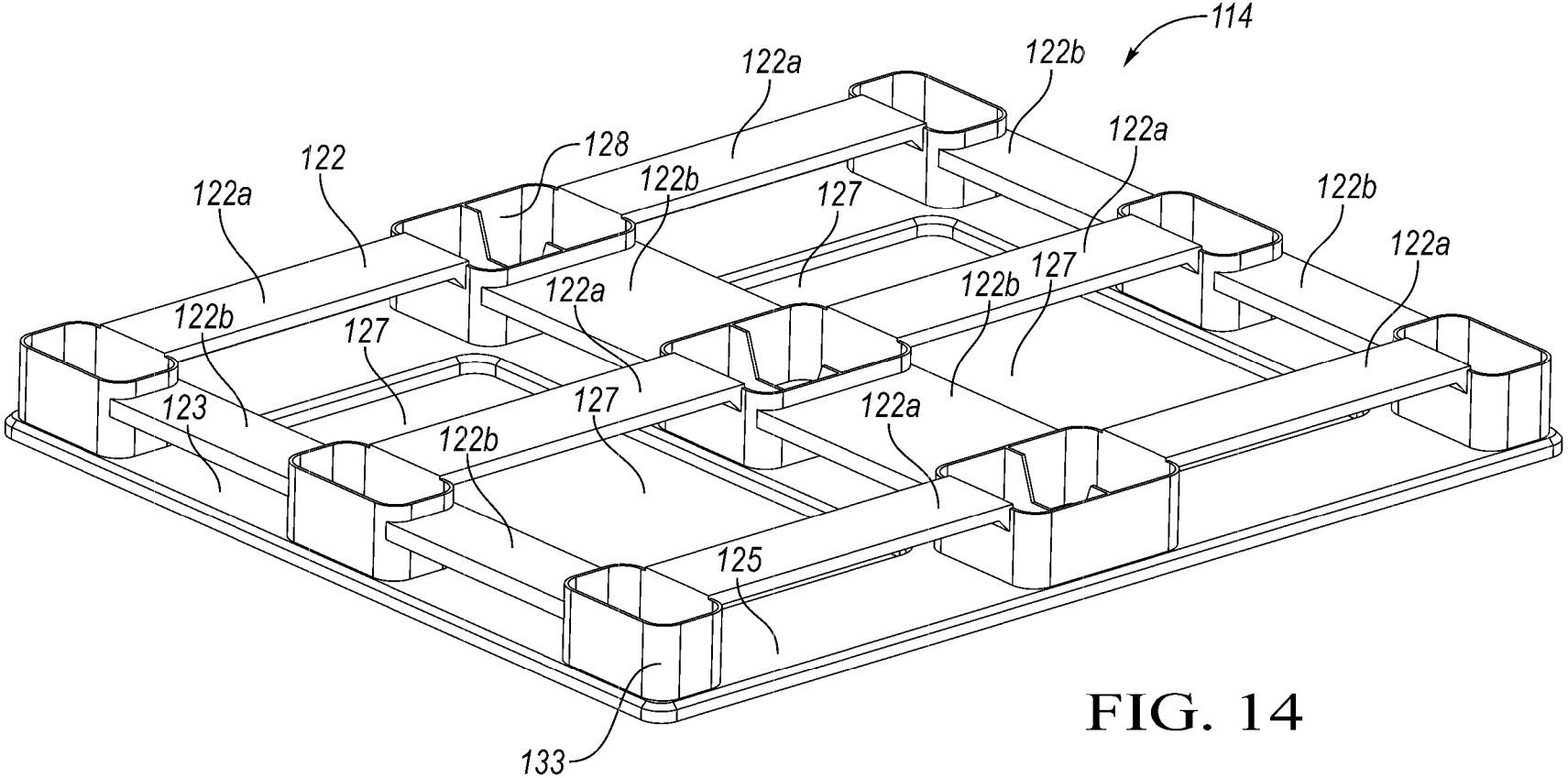
FIG. 14 is a perspective view of the support base of FIG. 14.
Figure 15:
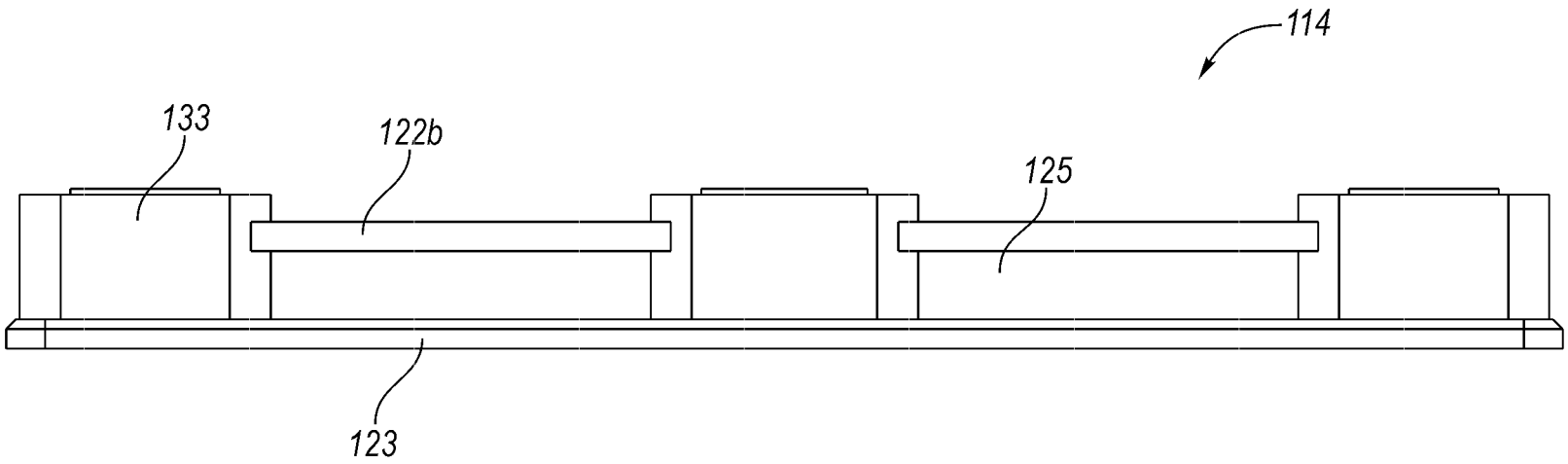
FIG. 15 is a side view of the support base of FIG. 14.
Figure 16:
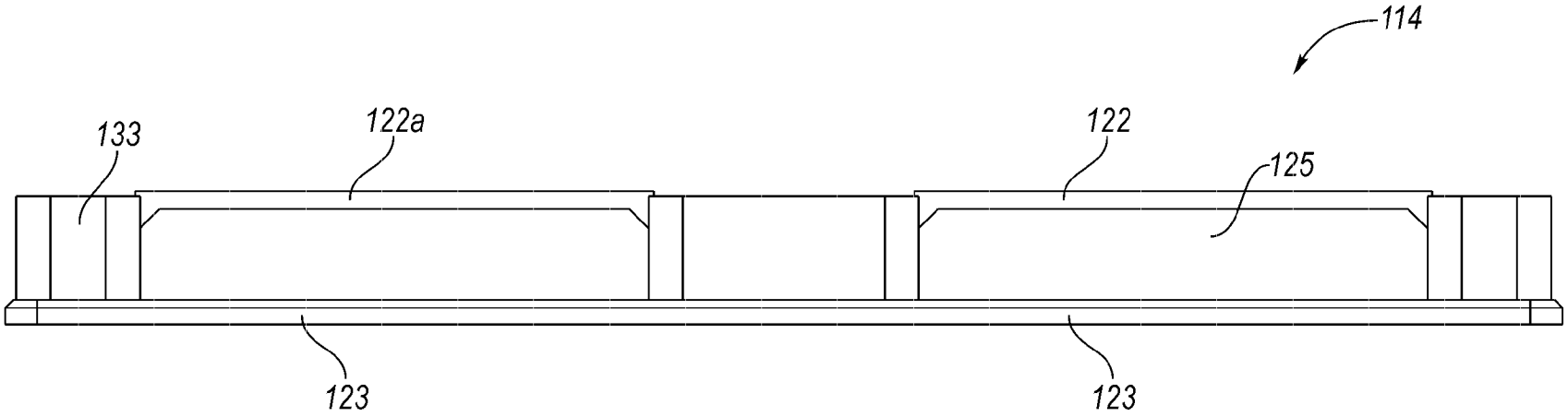
FIG. 16 is a front view of the support base of FIG. 14.
Figure 17:
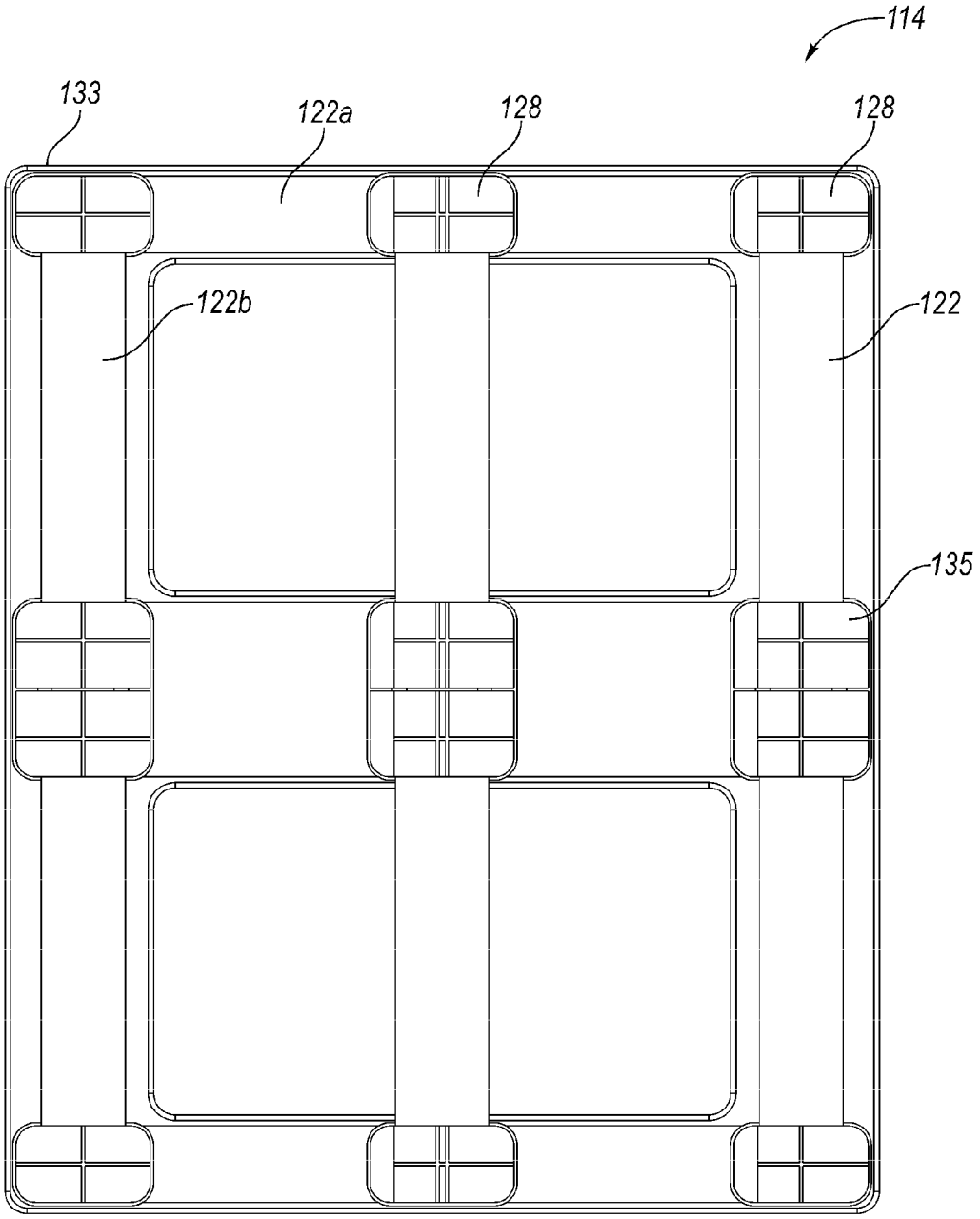
FIG. 17 is a top view of the support base of FIG. 14.

FIGS. 14, 15, 16 and 17 show the support base 114 that is supportable on the floor. FIG. 14 shows a perspective view of the support base 114, FIG. 15 shows a side view of the support base 114, FIG. 16 shows a front view of the support base 114, and FIG. 17 shows a top view of the support base 114. The support base 114 includes an upper deck portion 122 and a lower deck portion 123.

A plurality of columns 128 are formed through the deck 122 in the pattern of the feet 118 of the pallets 112 (FIG. 10). The columns 128 are each defined by wall section 133 that each extend between the upper deck portion 122 and the lower deck portion 123. The columns 128 each define an opening in the upper surface of the support base 114 down to the lower deck portion 123. In one example, a space 125 is defined between the upper deck portion 122 and the lower deck portion 123. The feet 118 of the pallets 112 contact floor ribs 135 of the support base 114 (shown in FIG. 17) of each of the columns 128 near the floor.

The upper deck portion 122 includes three pairs of upper deck segments 122*a* that are each substantially parallel to each other. Each pair of the upper deck segments 122*a* is separated by one of the columns 128. The upper deck portion 122 also includes three pairs of upper deck segments 122*b* that are substantially parallel to each other and substantially perpendicular to the pairs of the upper deck segments 122*a*. Each pair of the upper deck segments 122*b* is also separated by one of the columns 128. In one example, the upper deck segments 122*a* are spaced higher from the floor than the upper deck segments 122*b* are spaced from the floor. In one example, there are four openings 127 defined in the upper deck portion 122 and the lower deck portion 123 between the pairs of upper deck segments 122*a* and 122*b*.

In one example, the columns 128 that receive the column 118 of adjacent pallets 112 can be combined into a single opening that receives a column 118 of adjacent pallets 112 or be a single opening that includes a barrier wall that separates the single opening into two sections that each receive a column 118 of adjacent pallets 112.

Figure 18:
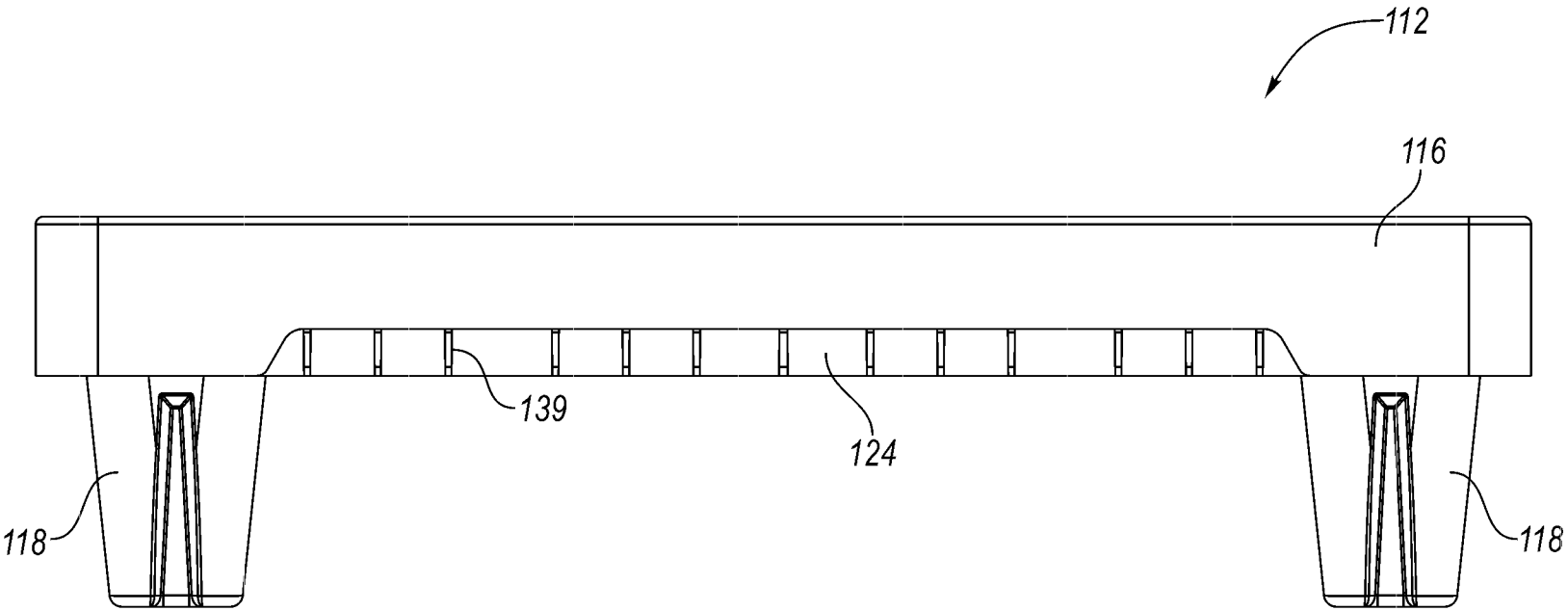
FIG. 18 is a front view of the pallet.
Figure 19:
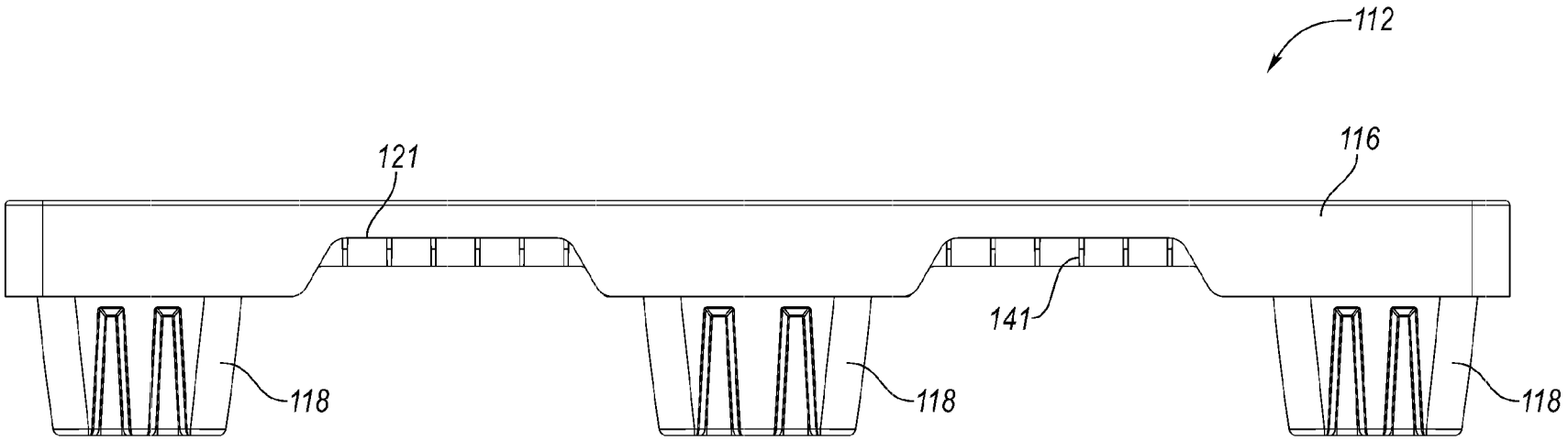
FIG. 19 is a side view of the pallet.
Figure 20:
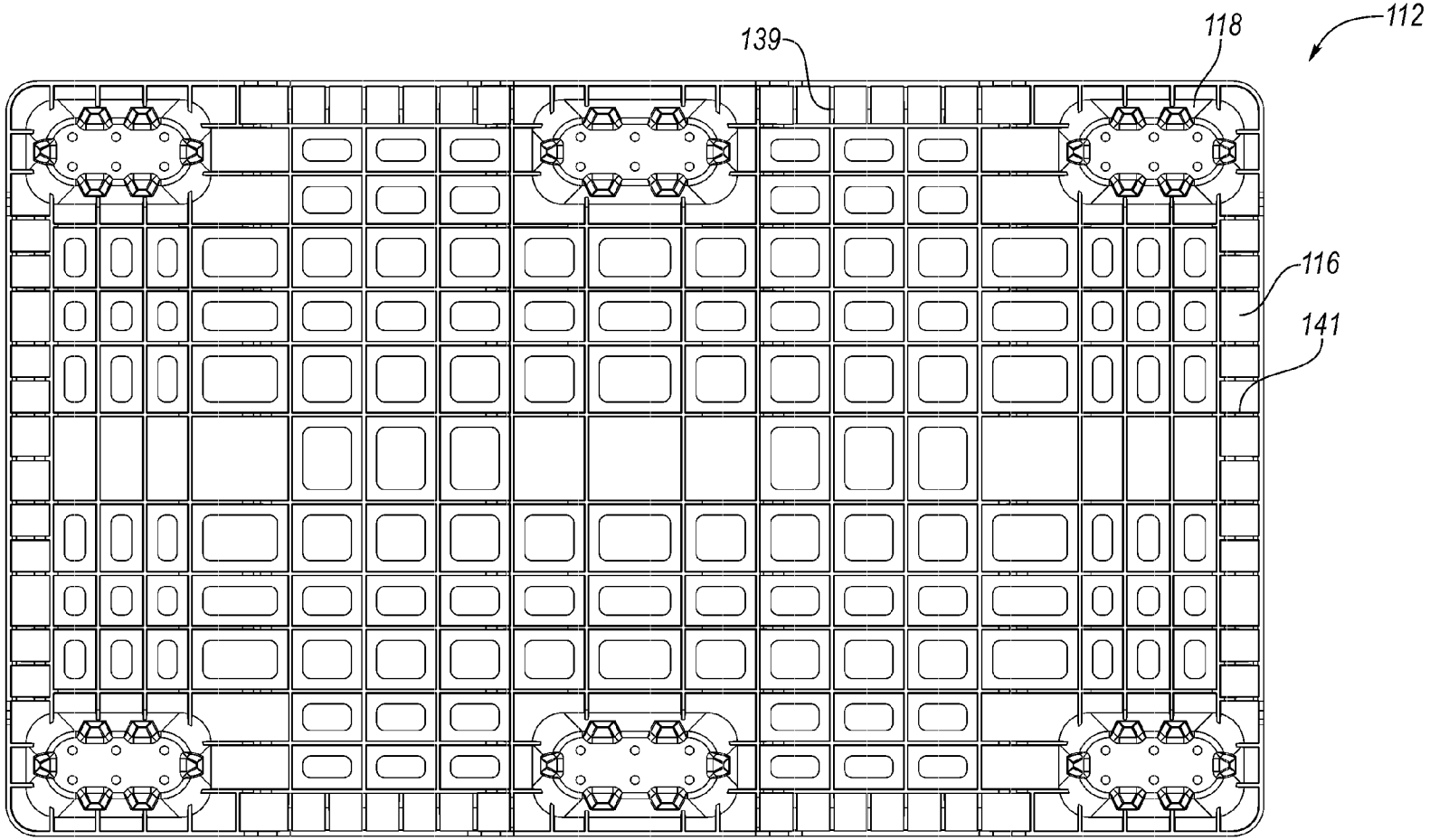
FIG. 20 is a bottom view of the pallet.

FIGS. 18, 19 and 20 show a pallet 112, as explained above. FIG. 18 shows a front view of the pallet 112, FIG. 19 shows a side view of the pallet 112, and FIG. 20 shows a bottom view of the pallet 112. A plurality of ribs 139 and 141 extend downwardly from the deck 116 of the pallets 112. The plurality of ribs 139 are located near the side of the pallets 112 with the recesses 124 (located at least partially above the upper deck segments 122*b*), and the plurality of ribs 141 are located near the side of the pallets 112 with the recesses 121 (located at least partially above the upper deck segments 122*a*). The plurality of ribs 141 extend closer to the floor than the plurality of ribs 139.

Figure 21:
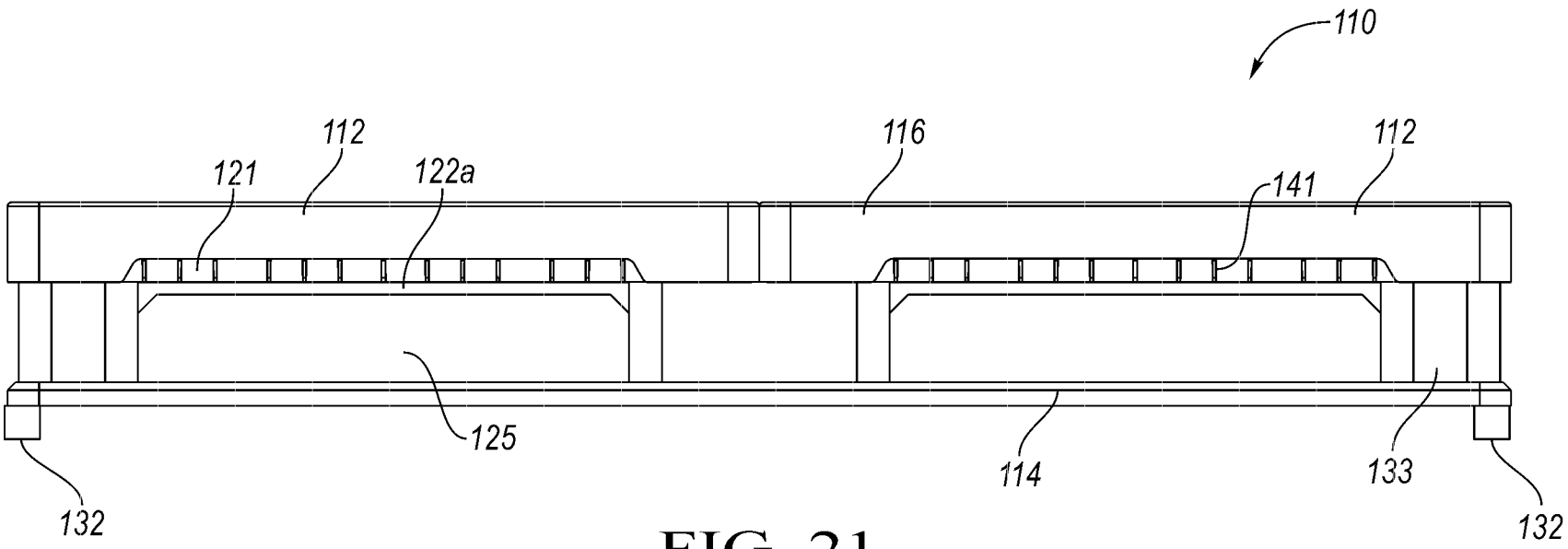
FIG. 21 is a front view of the pallet assembly of FIG. 10 supported on rack rails.
Figure 22:
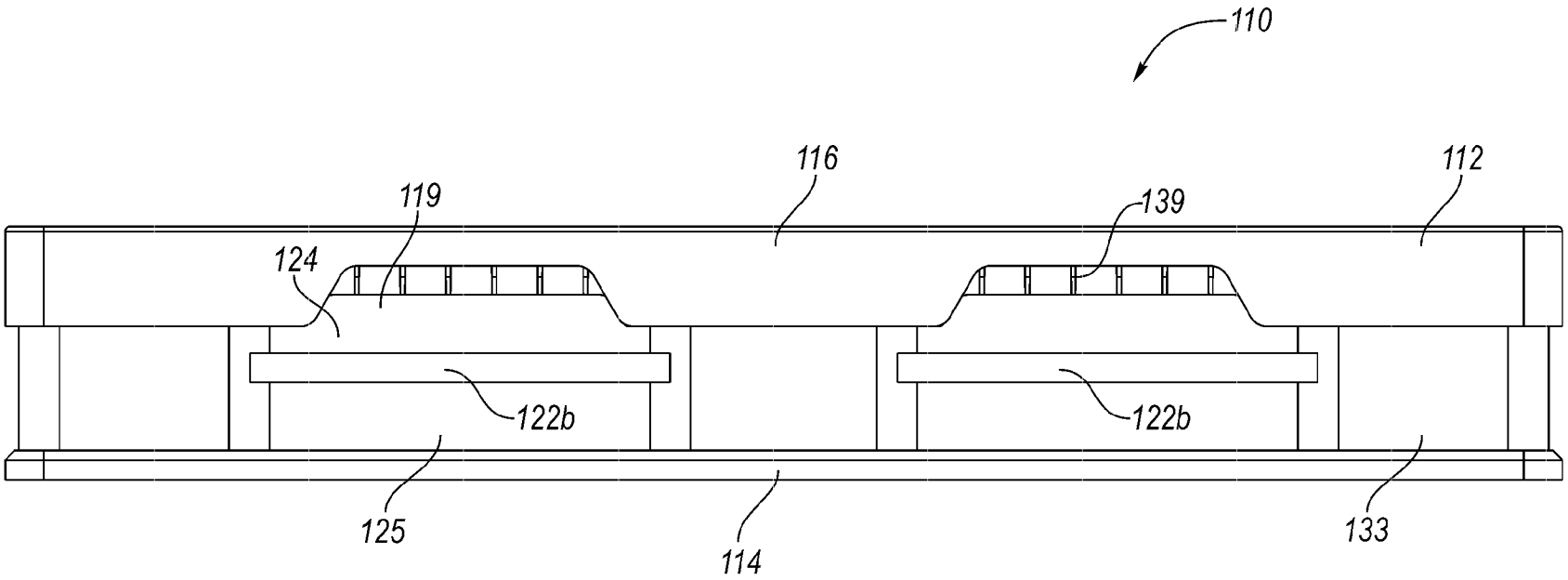
FIG. 22 is a side view of the pallet assembly of FIG. 10.

FIG. 21 shows a front view of the pallet assembly 110 of FIG. 1, and FIG. 22 shows a side view of the pallet assembly 110 of FIG. 1. The columns 118 of the pallets 112 are received in the columns 128 of the support base 114. The plurality of ribs 141 contact the upper deck segments 122*a* of the support base 114. The plurality of ribs 139 do not contact the upper deck segments 122*b* of the support base 114. A space 119 is defined between the plurality of ribs 139 near the upper deck segments 122*b* and the support base 114 so that the forklift can be received within the space 119 and under the pallets 112 to lift the pallets 112 relative to the support base 114. Alternatively, the forklift can be received within the space 125 to lift both the pallets 112 and the support base 114 together.

FIG. 21 shows the pallet assembly 110 supported on end rails 132 in a rack. When supported on the support base 114, the pallets 112 can be supported on a rack having end rails 132. The end rails 132 support the support base 114 outward of the corner columns 118

Optionally, a plurality of reinforcement members (such as steel rods, tubes, composite materials or stiffer materials, etc) may be used to reinforce the upper deck portion and/or the lower deck portion.

In accordance with the provisions of the patent statutes and jurisprudence, exemplary configurations described above are considered to represent a preferred embodiment of the invention. However, it should be noted that the invention can be practiced otherwise than as specifically illustrated and described without departing from its spirit or scope.

What is claimed is:

1. A pallet assembly comprising:

a support base including a support deck having a plurality of openings therethrough, a plurality of fork tine-receiving recesses defined below the support deck; and a plurality of pallets, each including a pallet deck having an upper support surface, wherein the upper support surfaces are generally coplanar, a plurality of feet extending downward from each of the pallet decks, the plurality of feet received in the plurality of openings in the support deck.

2. The pallet assembly of claim 1 wherein the plurality of feet extend down through the support deck, such that the plurality of feet can be supported on a floor.

3. The pallet assembly of claim 2 wherein the pallet decks each include a plurality of openings for receiving the feet of identical pallets nested thereon.

4. The pallet assembly of claim 1 wherein the support base includes an upper deck portion spaced above a lower deck portion.

5. The pallet assembly of claim 4 wherein the support base includes a plurality of columns defining the plurality of openings therethrough.

6. The pallet assembly of claim 5 wherein the pallet support base is supported at opposite ends in a pallet rack.

7. The pallet assembly of claim 1 wherein the pallet support base is molded as a single piece of plastic.

8. The pallet assembly of claim 7 wherein the plurality of pallets are each molded as a single piece of plastic.

9. A pallet assembly comprising:

a support base including a support deck having a plurality of openings therethrough, wherein the support base includes a plurality of fork tine-receiving recesses defined below the support deck; and a plurality of pallets, each including a pallet deck having a plurality of feet extending downward therefrom, the plurality of feet received in the plurality of openings in the support deck.

10. The pallet assembly of claim 9 wherein the pallet support base is supported at opposite ends in a pallet rack.

11. The pallet assembly of claim 9 wherein the plurality of feet extend down through the support deck, such that the plurality of feet can be supported on a floor.

12. The pallet assembly of claim 11 wherein the pallet decks each include a plurality of openings for receiving the feet of identical pallets nested thereon.

13. The pallet assembly of claim 9 wherein the support base includes an upper deck portion spaced above a lower deck portion.

14. The pallet assembly of claim 13 wherein the support base includes a plurality of columns defining the plurality of openings therethrough.

15. The pallet assembly of claim 14 wherein the pallet support base is supported at opposite ends in a pallet rack.

16. The pallet assembly of claim 15 wherein the pallet support base is molded as a single piece of plastic.

17. A pallet support base comprising:

a support deck including a plurality of columns defining a plurality of openings therethrough, the support deck including an upper support surface, wherein the support base includes an upper deck portion spaced above a lower deck portion, wherein the pallet support base is supported at opposite ends in a pallet rack such that the pallet support base is supported only on the pallet rack outward of the plurality of openings.

18. The pallet support base of claim 17 wherein the upper deck portion extend between the plurality of columns.

19. The pallet support base of claim 17 further including a plurality of fork tine-receiving recesses defined below the support deck.

* * * * *